United States Patent [19]

Lenoir et al.

[11] 3,984,971

[45] Oct. 12, 1976

[54] LID FOR PNEUMATIC YARN SPLICER

[75] Inventors: Fred White Lenoir, Hopewell; Bertrem Charles Wheeler, Chester, both of Va.

[73] Assignee: Allied Chemical Corporation, Petersburg, Va.

[22] Filed: Feb. 24, 1975

[21] Appl. No.: 552,397

[52] U.S. Cl. ..... 57/22
[51] Int. Cl.[2] ..... D01H 15/00
[58] Field of Search ..... 57/34 R, 22, 159

[56] References Cited

UNITED STATES PATENTS

| | | | |
|---|---|---|---|
| 3,070,947 | 1/1963 | Toledo et al. | 57/22 |
| 3,306,020 | 2/1967 | Rosenstein | 57/22 |
| 3,345,809 | 10/1967 | Gemeinhardt et al. | 57/22 |
| 3,477,217 | 11/1969 | Bell et al. | 57/22 |
| 3,581,486 | 6/1971 | Dibble | 57/22 |
| 3,822,538 | 7/1974 | Cardell | 57/22 |

*Primary Examiner*—Donald E. Watkins
*Attorney, Agent, or Firm*—Richard A. Anderson

[57] ABSTRACT

The method and apparatus of this invention comprises an improvement over the prior art wherein the splicing of two yarns is done in a zone entirely smooth-surfaced and non-resilient on any interior surface which can contact the yarns. This improved method and apparatus surprisingly was found effective for yarns which had been very difficult to splice with the old method and apparatus.

3 Claims, 3 Drawing Figures

LID FOR PNEUMATIC YARN SPLICER

BACKGROUND OF THE INVENTION

This invention relates to an improved lid for a pneumatic yarn splicer.

The prior art in U.S. Pat. Nos. 3,477,217 to Bell et al., 3,379,002 and 3,306,020 to Rosenstein, all of which are hereby incorporated by reference in toto, teach the use of a resilient material such as a soft foam type rubber in the splicer lid to seal the top of the V-shaped chamber or splicing zone and provides a surface for yarn contact during the splicing. The lid and gasket are shown in U.S. Pat. No. 3,477,217 in FIGS. 2, 3, 4, 6 as items 74 and 77, and items 12 and 20 in FIG. 5 of the above Rosenstein patents. The rubber is subject to wear and in addition, has been found inadequate for providing a satisfactory splice with some difficult yarns such as heavy denier delta (triangular-shaped) yarns with antistatic or other additives in them.

The prior art method of splicing together two multifilament yarns comprises the steps of laying the end portions over the two yarns together in opposed overlapping relation in a laterally-confined longitudinally-open splicing zone, passing a longitudinally-disposed laterally-narrow shaft of compressed air through the overlapping ends of yarns at an intermediate point in the overlap region to spread the filaments of both yarns laterally apart at that point, then exhausting the air axially along the overlapping yarn ends in opposing directions from said intermediate point to agitate and entangle the filaments of one yarn with those of the other.

The prior art apparatus for air splicing together two multifilament yarns comprises a splicing box having extending axially therethrough a passage open at both ends, opposite end portions of said passage having a narrow notch for receiving the yarns spliced in superposed overlapping relation, the intermediate portion of said passage of enlarged cross-section forming a splicing chamber; an input connection for compressed air; a laterally-narrow axially-disposed slot extending from the compressed air input connection to the splicing chamber for injecting a narrow wedge of compressed air through said superposed yarns to spread apart the filaments thereof at said injection point, said compressed air then exhausting through the chamber in opposite axial directions.

SUMMARY OF THE INVENTION

Installation of a thin metal strip over the rubber gasket on the lid in the area where yarn contact occurs in the splicing zone eliminates wear. Unexpectedly, it also produces satisfactory splices with yarns having cross-sections or additives which cannot be achieved with the all rubber lid. The thin metal strip or shim must be limited to the lid area where yarn contact occurs or else it will interfere with the seal of the gasket.

The improvement of this invention comprises the method of splicing the yarns in the splicing zone with that zone being entirely smooth-surfaced and non-resilient on any interior surface which can contact the yarns. This surface can be achieved by either fastening a shim to the inside face of the gasket or by eliminating that portion of the gasket which would contact the yarns and dimensioning the inside surface of the lid to have the proper dimensions so that the yarns will still entangle to make a splice.

Thus, in the preferred embodiment, the method improvement is in the splicing zone having a lid with the lid having a resilient gasket adjacent to and in the splicing zone, the improvement comprising splicing the yarns in the presence of a smooth-surfaced non-resilient shim fastened to the gasket in the splicing zone, with the shim limited in area to the lid area where yarn contact occurs. Preferably, the shim is metal.

The apparatus improvement of this invention is the splicing chamber being entirely smooth-surfaced and non-resilient on any interior surface which can contact the yarns. The preferred embodiment is on the prior art splicing chamber having a lid, the lid having resilient gasket adjacent the splicing chamber, and the improvement comprises the resilient gasket having a thin covering of a smooth-surfaced non-resilient material fastened thereto and in the splicing chamber, with the material limited in area to the lid area where yarn contact occurs.

The preferred material is metal.

DESCRIPTION OF THE PREFERRED EMBODIMENTS

Figure 1:
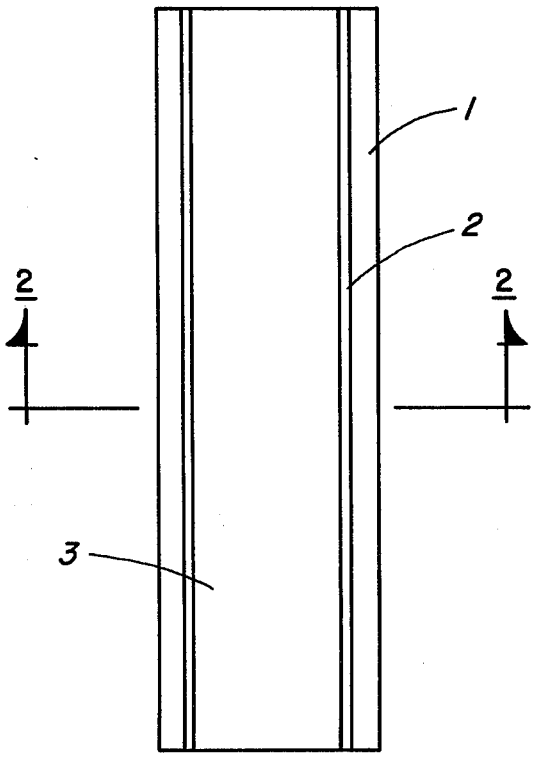
Figure 2:
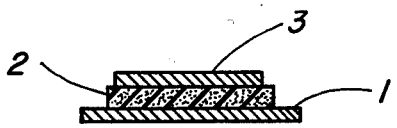

FIGS. 1 and 2 show a plan and an end view in cross section of the improved lid of the preferred embodiment of this invention. In both FIGS., 1 is the lid, 2 is the gasket and 3 is the shim.

Figure 3:
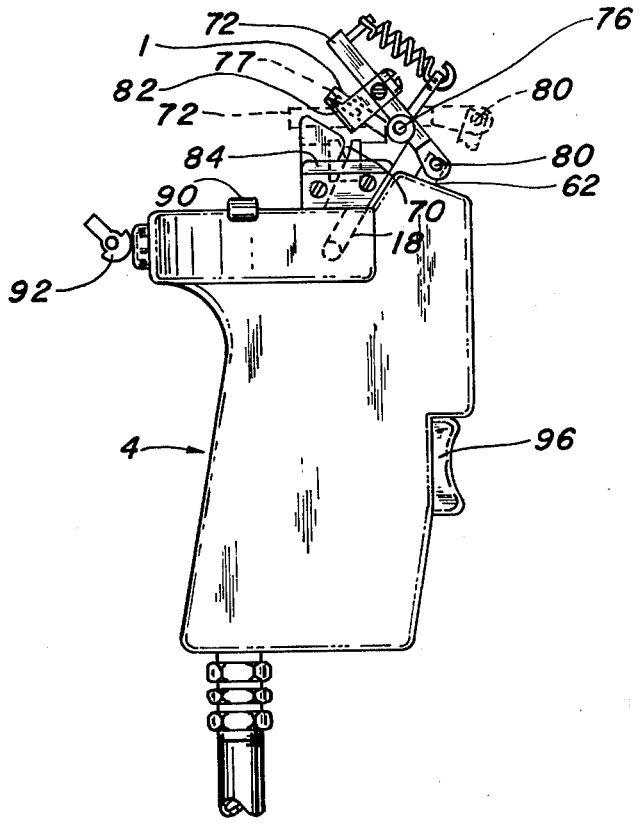
FIG.3 PRIOR ART

FIG. 3 represents the prior art from U.S. Pat. No. 3,477,217 to Bell (previously incorporated by reference) and is a side elevation with the cover shown in open position.

In FIG. 3, lid 1 is shown on the prior art apparatus in its position as shown, on splicer body 4. A yarn inlet passageway 18 branches away from near splicing chamber 70 to exit body 4.

A preferred splicing head is of the general construction described and illustrated in U.S. Pat. No. 3,306,020 of Feb. 28, 1967 to N. Rosenstein. This head comprises an open-ended splicing chamber of V cross section, indicated in the drawings generally by numeral 70. The splicing chamber 70 will have at least one slot longitudinally disposed along the junction of the walls forming the V and can also, e. g. for use with relatively heavy yarns, have two or more such slots. Easily interchangeable chambers can be provided, differing in width of the V angle and/or in having only one vs. two longitudinal slots. The V angle can vary from say 15° to 90°, being wider for heavier yarns.

A preferred cover of the splicing chamber consists of upper lid 72 and lower lid 1 hinged together at hinge 76 and urged apart in jaw-like fashion by a spring. The lower lid or sealing cover 1 is provided with a gasket 77 which bears against the top of splicing chamber 70 to cover the same tightly while leaving the V shaped chamber open at both ends to allow escape of air therefrom.

The upper lid 72 is attached by pivot pin 80 to the upper end of arm 62. This upper lid 72 carries a pair of cutting blades 82 which meet corresponding fixed cutting blades 84 at points closely adjacent to each end of splicing chamber 70, to trim the yarn ends off close to the splicing zone. A pair of yarn guides 86 with slots 88 are provided at each end of splicing chamber 70 to facilitate placing yarn in chamber 70 and bringing it across one fixed cutting edge 84, through the chamber 70, and around the far end of the chamber without crossing the far cutting edge.

A spring clip or button 90 is provided to hold each yarn after stringing into the chamber 70.

Numeral 92 designates a camming switch operable by the thumb to turn the apparatus "on", pulling trigger 96 then begins the operation of splicing.

The previously available pneumatic air splice guns equipped with standard rubber lid material proved to be satisfactory for splicing heavy denier cross-section undrawn carpet yarn having a cross-section shaped as a Y. The criteria for accepting a splice is that at least 18–20 splices must have an Instron breaking strength of at least 1800 grams. The previously available prior art splice guns proved inadequate for splicing a 3000 denier undrawn yarn having a delta or triangular shaped cross-section and having an antistatic additive. After installation of the metal shim in the lids as shown in FIGS. 1 and 2, all of the splicers met the above stated criteria with the 3000 denier delta cross-section antistatic additive undrawn yarn. Thus, installation of a thin metal strip to prevent wearing of the rubber in the area where the yarn contacts in the splicing passage or zone, that is, the feed block lid, did eliminate wear. But unexpectedly, it also produced satisfactory splices with the very difficult cross-sections to splice which could not be achieved with the prior art, all rubber lid.

We claim:

1. In an apparatus for air splicing together two multifilament yarns comprising a splicing box having extending axially therethrough a passage open at both ends, opposite end portions of said passage having a narrow notch for receiving the yarns to be spliced in superposed overlapping relation, the intermediate portion of said passage being of enlarged cross section forming a splicing chamber; an input connection for compressed air; a laterally-narrow axially-disposed slot extending from said compressed-air input connection to said splicing chamber for injecting a narrow wedge of compressed air through said superposed yarns to spread apart the filaments thereof at said injection point, said compressed air then exhausting through said chamber in opposite axial directions, the improvement comprising said chamber being entirely smooth-surfaced and non-resilient on any interior surface which can contact said yarns.

2. In an apparatus for air splicing together two multifilament yarns comprising a splicing box having extending axially therethrough a passage open at both ends, opposite end portions of said passage having a narrow notch for receiving the yarns to be spliced in superposed overlapping relation, the intermediate portion of said passage being of enlarged cross section forming a splicing chamber; an input connection for compressed air; a laterally-narrow axially-disposed slot extending from said compressed-air input connection to said splicing chamber for injecting a narrow wedge of compressed air through said superposed yarns to spread apart the filaments thereof at said injection point, said compressed air then exhausting through said chamber in opposite axial directions, said passage having a lid, said lid having a resilient gasket adjacent said passage, the improvement comprising said resilient gasket having a thin covering of a smooth-surfaced non-resilient material fastened thereto in said chamber, with the material limited in area to the lid area where yarn contact occurs.

3. The apparatus of claim 2 wherein said material is metal.

* * * * *